US006216334B1

(12) United States Patent
Hughes

(10) Patent No.: US 6,216,334 B1
(45) Date of Patent: Apr. 17, 2001

(54) ELECTRIC HEATER AND METHOD OF MANUFACTURE

(75) Inventor: John Thomas Hughes, Stanford Bridge (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 09/038,222

(22) Filed: Mar. 11, 1998

(30) Foreign Application Priority Data

Apr. 12, 1997 (GB) ..... 9707466

(51) Int. Cl.[7] ..... H05B 3/00

(52) U.S. Cl. ..... 29/611; 219/463; 219/467; 29/831; 29/848; 29/860

(58) Field of Search ..... 29/610, 611, 613, 29/846, 831; 219/200, 201, 457, 264, 259, 245, 243, 443, 440

(56) References Cited

U.S. PATENT DOCUMENTS 600,057 3/1898 Ball .
3,680,207 * 8/1972 Belmonte et al. ..... 29/611
5,369,874 * 12/1994 Mcwilliams ..... 29/611
5,477,605 * 12/1995 Mcwilliams et al. ..... 29/611

FOREIGN PATENT DOCUMENTS 9313218 10/1993 (DE) .
540955 11/1941 (GB) .
1569588 6/1980 (GB) .

OTHER PUBLICATIONS

European Search Report.

* cited by examiner

*Primary Examiner*—Lee Young
*Assistant Examiner*—Sean Smith
(74) *Attorney, Agent, or Firm*—Ira S. Dorman

(57) ABSTRACT

A flexible electric heater comprises a heat resistant support (4) of sheet or tape form having at least one electrical resistance heating element (1) secured thereto. The at least one heating element comprises a ribbon (2) of electrical resistance material provided with a plurality of integral tabs (3). The tabs have been pressed through the support to secure the heating element to the support. The support (4) is flexible and comprises a woven fabric material, such as woven glass fabric or woven ceramic fabric, or a non-fibrous material, such as flexible mica.

15 Claims, 1 Drawing Sheet

ELECTRIC HEATER AND METHOD OF MANUFACTURE

This invention relates to a flexible electric heater and a method of manufacturing such a heater.

DESCRIPTION OF PRIOR ART

GB-A-1 569 588 (E.G.O. Elektro-Gerate Blanc u. Fischer) describes an electrical radiation heater for a glass ceramic plate in which anchoring tabs formed at the lower edge of a heating conductor strip pass entirely through an annular sheet and are bent over in a region below a notch formed in each tab in order to hold the heating conductor strip against the sheet. The annular sheet has the structure of a relatively strong cardboard material made from a high temperature-resistant insulating material. The material of the sheet is a fibrous insulating material which is combined with a ceramic binder to form an insulating board, such as that sold under the Registered trade Mark FIBERFRAX. The tabs are sufficiently strong to pierce the board-like material of the annular sheet and a rotary tool is then used to press down the lugs formed beyond the notches against the underside of the annular sheet.

The disadvantage of such a bound fibrous support is that it is brittle and lacks flexibility. Therefore the support tends to break if any attempt is made to flex the same.

OBJECT OF THE INVENTION

It is an object of the present invention to provide an electric heater which is relatively flexible.

SUMMARY OF THE INVENTION

According to one aspect of the invention there is provided a flexible electric heater comprising a heat resistant support of sheet or tape form having at least one electrical resistance heating element secured thereto, the at least one heating element comprising a ribbon of electrical resistance material provided with a plurality of integral tabs extending therefrom, the tabs having been pressed through the support, wherein the support is flexible and comprises a woven fabric material or a non-fibrous material.

The tabs of the ribbon may protrude from a rear surface of the support and may be deformed at that rear surface, such as by being bent, twisted or buckled.

According to another aspect of the invention there is provided a method of manufacturing a flexible electric heater comprising:

providing a heat resistant support of sheet or tape form;

providing at least one electrical resistance heating element comprising a ribbon of electrical resistance material provided with a plurality of integral tabs extending therefrom; and urging the tabs of the ribbon through the support to secure the heating element to the support wherein the support is flexible and comprises a woven fabric material or a non-fibrous material.

The tabs may be urged through the support from a front surface thereof such that they emerge from a rear surface of the support and are deformed at the rear surface, such as by bending, twisting or buckling.

During urging of the tabs of the ribbon through the support, plate means may be provided in contact with the rear surface of the support, the emerging tabs being deformed against the plate means.

The plate means may comprise a substantially firm or hard material, such as metal, plastics or rubber.

The ribbon may be provided with the plurality of tabs extending edgewise therefrom.

The tabs may be arranged such that the ribbon is secured edgewise to the support.

The ribbon may be provided of corrugated form.

The support may be of any suitable flexible heat resistant sheet or tape form material, of woven fabric material or non-fibrous material, capable of having the tabs of the heating element pressed therethrough and capable of withstanding the operating temperature conditions of the heater.

The support may comprise flexible non-fibrous mica or may comprise woven glass fabric or woven ceramic fabric.

The invention is now described by way of example with reference to the accompanying drawings in which:

DESCRIPTION OF PREFERRED EMBODIMENT

A radiant electric heating element 1 for a flexible radiant heater according to the invention comprises a corrugated ribbon 2 of bare electrical resistance material, such as iron-chromium-aluminium alloy, provided along its length with a plurality of tabs 3, the tabs extending edgewise from the ribbon and integral and substantially coplanar therewith. The tabs may be substantially rectangular or triangular in shape with each side of the tabs being continuous, that is without deformations such as notches.

A flexible support 4 for the heating element is provided of sheet or tape form and comprises a suitably heat resistant material such as flexible (non-fibrous) mica or woven glass fabric or woven ceramic fabric. An example of woven ceramic fabric is Nextel (Registered Trade Mark) 312, manufactured by 3M Co.

Figure 3:
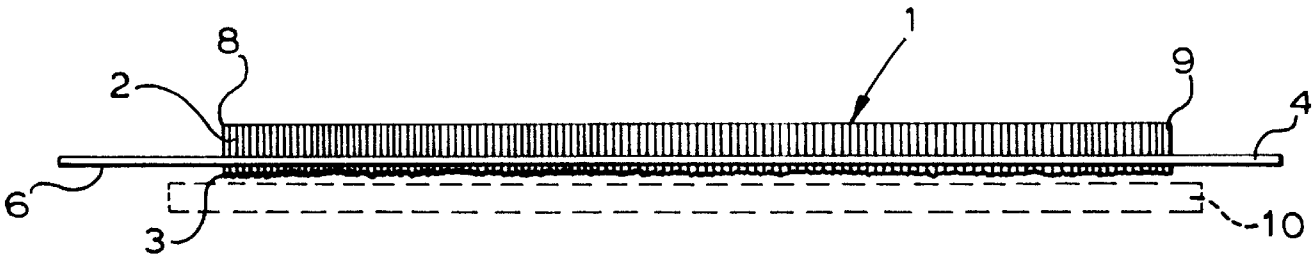
FIG. 3 is a side view of the heater of FIG. 2.

The corrugated heating element 1 is pre-formed into a meandered shape and located with the corrugated ribbon edgewise on the flexible support 4 and with the ends 5 of the tabs 3 in contact with a front surface of the support. Using a simple press tool, pressure is applied between the ribbon 2 and the support 4 to urge the tabs 3, end 5 first, through the support 4. The tabs 3 protrude from a rear surface 6 of the support and are bent over or twisted or caused to buckle, as shown in FIG. 3 whereby the heating element is secured to the support 4 with the corrugated ribbon 2 edgewise thereon. The press tool includes a plate 10 of a substantially firm or hard material, such as metal, plastics or rubber. During urging of the tabs 3 through the support 4, the plate 10 is arranged to contact the rear surface 6 of the support and when the tabs 3 emerge from the rear surface they are deformed against the plate, i.e. bent over, twisted or buckled, thereby securing the heating element to the support.

Figure 1:
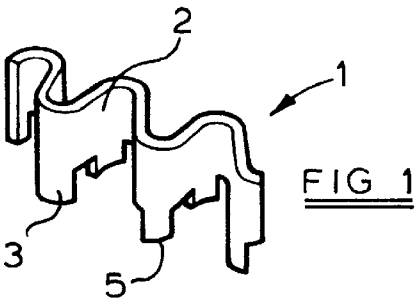
FIG. 1 is an enlarged perspective view of a portion of corrugated ribbon form electrical resistance heating element for use in a heater according to the invention.
Figure 2:
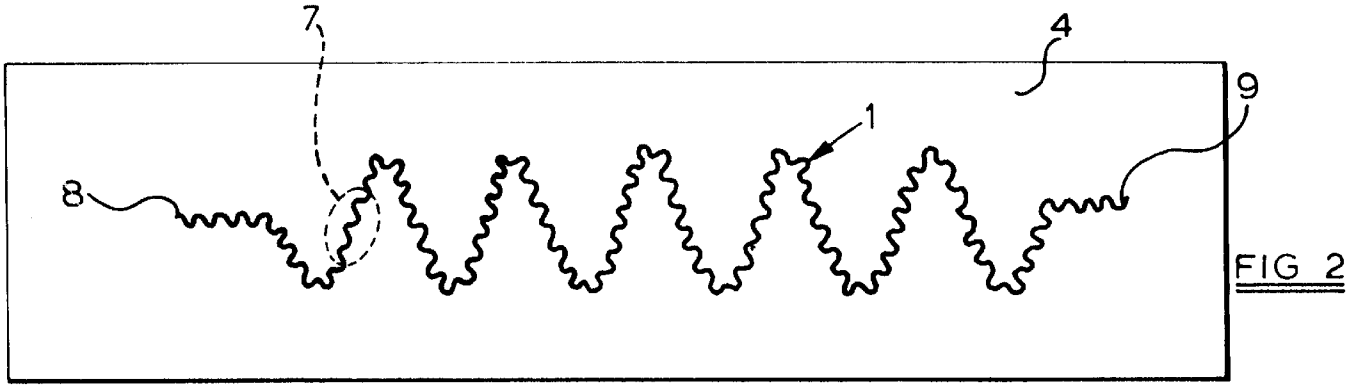
FIG. 2 is a plan view of a heater according to the invention incorporating the heating element of FIG. 1.

For the sake of clarity, the portion of the heating element 1 shown in FIG. 1 is a detail of a section represented by reference numeral 7 in FIG. 2.

The resulting heater may be flexed into any desired shape according to its required application, with the ends 8, 9 of the heating element arranged for electrical connection to an appropriate voltage source.

What is claimed is:

1. A flexible electric heater made by a method of manufacturing, which method comprises:

providing a heat resistant support selected from the class consisting of sheet and tape forms of supports, the support being flexible and being selected from the group consisting of a woven fabric and a non-fibrous material;

providing at least one electrical resistance heating element comprising a length of ribbon of electrical resistance material provided with a multiplicity of integral tabs extending therefrom and distributed along the length thereof;

urging the tabs of the ribbon through the support so as to cause the tabs to emerge from a rear surface of the support; and deforming the tabs at the rear surface of the support to secure the heating element.

2. A heater according to claim 1, wherein the tabs are deformed by means selected from bending, twisting and buckling.

3. A heater according to claim 1, wherein the tabs extend edgewise from the ribbon.

4. A heater according to claim 3, wherein the tabs are arranged such that the ribbon is secured edgewise to the support.

5. A heater according to claim 1, wherein the ribbon is of corrugated form.

6. A heater according to claim 1, wherein the support is selected from flexible non-fibrous mica, woven glass fabric and woven ceramic fabric.

7. A method of manufacturing a flexible electric heater comprising:

providing a heat resistant support selected from the class consisting of sheet and tape forms of supports, the support being flexible and being selected from the group consisting of a woven fabric and a non-fibrous material;

providing at least one electrical resistance heating element comprising a length of ribbon of electrical resistance material provided with a multiplicity of integral tabs extending therefrom and distributed along the length thereof;

urging the tabs of the ribbon through the support so as to cause the tabs to emerge from a rear surface of the support; and deforming the tabs at the rear surface of the support to secure the heating element to the support.

8. A method according to claim 7, wherein the tabs are deformed by means selected from bending, twisting and buckling.

9. A method according to claim 7, wherein during urging of the tabs of the ribbon through the support, a plate means is provided adjacent the rear surface of the support, the emerging tabs being deformed against the plate means.

10. A method according to claim 9, wherein the plate means is selected from substantially firm and hard material.

11. A method according to claim 10, wherein the plate means is selected from metal, plastics and rubber.

12. A method according to claim 7, wherein the tabs extend edgewise from the ribbon.

13. A method according to claim 12, wherein the tabs are arranged such that the ribbon is secured edgewise to the support.

14. A method according to claim 7, wherein the ribbon is of corrugated form.

15. A method according to claim 7, wherein the support is selected from flexible non-fibrous mica, woven glass fabric and woven ceramic fabric.

* * * * *